US005810952A

United States Patent [19]

Farrar, Jr. et al.

[11] Patent Number: 5,810,952

[45] Date of Patent: Sep. 22, 1998

[54] LEAD-FREE 6000 SERIES ALUMINUM ALLOY

[75] Inventors: Larry E. Farrar, Jr.; Norman LeRoy Coats, II, both of Jackson, Tenn.

[73] Assignee: Kaiser Aluminum & Chemical Corporation, Pleasanton, Calif.

[21] Appl. No.: 742,781

[22] Filed: Oct. 31, 1996

Related U.S. Application Data

[62] Division of Ser. No. 518,726, Aug. 24, 1995.

[51] Int. Cl.[6] ..... C22C 21/00

[52] U.S. Cl. ..... 148/690; 148/701; 148/688; 148/689; 148/417

[58] Field of Search ..... 148/701, 690, 148/688, 689, 417

[56] References Cited

U.S. PATENT DOCUMENTS

| | | | |
|---|---|---|---|
| 2,026,575 | 1/1936 | Kempf et al. | 75/1 |
| 2,026,576 | 1/1936 | Kempf et al. | 75/1 |
| 2,076,571 | 4/1937 | Kempf et al. | 75/140 |
| 4,010,046 | 3/1977 | Setzer et al. | 148/11.5 A |
| 4,066,480 | 1/1978 | Gullotti et al. | 148/11.5 A |
| 4,589,932 | 5/1986 | Park | 148/12.7 |
| 5,122,208 | 6/1992 | Alabi | 148/440 |
| 5,176,763 | 1/1993 | Byrne et al. | 148/692 |
| 5,192,378 | 3/1993 | Doherty et al. | 148/691 |
| 5,194,102 | 3/1993 | Wyss | 148/695 |
| 5,240,522 | 8/1993 | Tanaka et al. | 148/693 |
| 5,282,909 | 2/1994 | Ara et al. . | |
| 5,342,459 | 8/1994 | Klemp et al. | 148/690 |
| 5,587,029 | 12/1996 | Sircar | 148/438 |

FOREIGN PATENT DOCUMENTS

| | | |
|---|---|---|
| 62-214150 | 9/1987 | Japan . |
| 63-007354 | 1/1988 | Japan . |
| 1-283338 | 11/1989 | Japan . |
| 3-039442 | 2/1991 | Japan . |
| 4-120236 | 4/1992 | Japan . |
| 6-049575 | 2/1994 | Japan . |
| 7-097653 | 4/1995 | Japan . |
| 7-173567 | 7/1995 | Japan . |
| WO96/08586 | 3/1996 | WIPO . |
| WO96/13617 | 5/1996 | WIPO . |

*Primary Examiner*—Patrick Ryan
*Assistant Examiner*—M. Alexandra Elve
*Attorney, Agent, or Firm*—Philip L. McGarrigle; Gerald D. Haynes

[57] ABSTRACT

A process for making an essentially lead-free screw machine stock alloy, comprising the steps of providing a cast aluminum ingot having a composition consisting essentially of about 0.55 to 0.70 wt. % silicon, about 0.15 to 0.45 wt. % iron, about 0.30 to 0.40 wt. % copper, about 0.8 to 0.15 wt. % manganese, about 0.80 to 1.10 wt. % magnesium, about 0.08 to 0.14 wt. % chromium, nor more than about 0.25 wt. % zinc, about 0.007 to 0.07 wt. % titanium, about 0.20 to 0.8 wt. % bismuth, about 0.15 to 0.25 wt. % tin, balance aluminum and unavoidable impurities; homogenizing the alloy at a temperature ranging from about 900° to 1060° F. for a time period of at least 1 hour; cooling to room temperature; cutting the ingot into billets; heating and extruding the billets into a desired shape; and thermomechanically treating the extruded alloy shape.

15 Claims, No Drawings

LEAD-FREE 6000 SERIES ALUMINUM ALLOY

This is a division, of application Ser. No. 08/518,726, filed Aug. 24, 1995.

BACKGROUND OF THE INVENTION

1. Field of the Invention

The present invention relates to a lead-free aluminum screw-machine stock alloy. More specifically, the invention relates to an essentially lead-free, tin and bismuth containing aluminum alloy screw machine stock and the process of making such an alloy.

2. Description of the Related Art

Conventional aluminum alloys used for screw machine stock contain, among other alloying elements, lead. Workers in the field add lead to conventional aluminum screw machine stock alloys because it enhances the chipping characteristics of the alloy. There has been, however, a growing concern regarding the health hazard created by the presence of lead in many materials including the presence of lead in conventional aluminum alloy screw machine stock. As a result, workers in the field have attempted to develop an aluminum alloy for screw machine stock that is essentially lead-free.

Use of tin in aluminum alloys employed for mechanical cutting operations, such as boring, drilling or lathe-cutting, has been known for many years. For example, U.S. Pat. No. 2,026,571 to Kempf et al., describes a free cutting aluminum alloy which contains copper, silicon and tin. The copper content of this cutting alloy contains 3 to 12 wt. % copper, 0.5 to 2.0 wt. % silicon, and 0.005 to 0.1 wt. % tin. It also may contain 0.05 to 6 wt. % of one or more of the following elements: bismuth, thallium, cadmium, or lead. In order to improve the cutting properties of this alloy, Kempf et al suggest subjecting it to a solution heat treatment and cold drawing.

Two other patents, U.S. Pat. Nos. 2,026,575 and 2,026,576, both to Kempf et al., describe a free cutting aluminum alloy containing 4 to 12 wt. % copper, 0.01 to 2 wt. % tin, and 0.05 to 1.5 wt. % bismuth. It mentions that to alter the physical properties, these alloys can be subjected to the "usual heat treatments", but this 60 year old patent fails to specify any particular thermomechanical steps that would assist in obtaining desirable physical properties. Moreover, both of these patents teach that the "simultaneous presence of more than one of the free machining elements is more advantageous than that of the same total amount of either of the elements used separately". (See Kempf et al. '076, at column 2, lines 42–45). Specifically, Kempf et al. state that "it is more advantageous to make up this 1.5 per cent by using more than one of the elements lead, bismuth or thallium, than to add 1.5 per cent of one element alone". (See Kempf et al. '076, at column 2, lines 51 et seq.). Thus, these two patents suggest that in order to obtain the best free machining properties from the alloy composition, more than one free machining elements should be added to the aluminum-copper alloy.

A more current reference, U.S. Pat. No. 5,122,208 to Alabi, discloses a wear-resistant and self-lubricating aluminum alloy which contains relatively substantial additions of tin and bismuth. This alloy has a tin content of 0.5 to 3 wt. % with a corresponding quantity of bismuth content. It has, however, a very high silicon content and a very low copper level which makes it unsuitable for use as a screw machine stock alloy. Tin and bismuth containing aluminum alloys are also employed in the manufacture of sacrificial anodes, however, the compositions of the conventional aluminum alloy sacrificial anodes make them unsuitable for use as screw machine stock.

In addition to the aluminum screw machine stock alloy being lead-free, such an alloy should also exhibit mechanical and physical properties equivalent to its lead-containing counterparts. Thus, a need remains for an aluminum screw machine stock alloy that is lead-free while still maintaining mechanical and physical properties equivalent to its lead-containing screw machines stock alloy counterparts. Accordingly, it is an object of this invention to provide such an alloy.

SUMMARY OF THE INVENTION

The present invention comprises an essentially lead-free, extruded and then solution heat-treated aluminum screw machine stock alloy consisting essentially of about 0.40 to 0.8 wt. % silicon, not more than about 0.7 wt. % iron, about 0.15 to 0.40 wt. % copper, not more than about 0.15 wt. % manganese, about 0.8 to 1.2 wt. % magnesium, about 0.04 to 0.14 wt. % chromium, not more than about 0.25 wt. % zinc, not more than about 0.15 wt. % titanium, about 0.10 to 0.7 wt. % tin, and about 0.20 to 0.8 wt. % bismuth, balance aluminum and unavoidable impurities.

The process of making such an alloy includes the steps of homogenizing the ingot at a temperature ranging from about 900° to 1060° F. for a time period of at least 1 hour, cooling, cutting the ingot into billets, heating and extruding the billets into a desired shape, and thermomechanically treating the extruded alloy shape.

The foregoing and other objects, features, and advantages of the invention will become more readily apparent from the following detailed description of preferred embodiment which proceeds with reference to the drawings.

DETAILED DESCRIPTION OF THE INVENTION

The present invention relates to a lead-free aluminum screw-machine stock alloy and the process for making such alloy. More specifically, the invention relates to an essentially lead-free, tin and bismuth containing aluminum alloy screw machine stock and the process of making such an alloy. We have found that if we replace the lead content of the conventional aluminum alloy for screw machine stock with a quantity of tin, and then subject that alloy to thermal mechanical treatment, we obtain an alloy that exhibits at least the equivalent physical and mechanical properties exhibited by the lead containing aluminum screw machine stock alloy without encountering any significant health hazards which the conventional lead-containing alloys may create.

Aluminum screw machine stock is generally manufactured in the rod or bar form to be used in screw machines. Aluminum alloy screw machine stock must exhibit the best possible machinability and chip breakage characteristics for that particular alloy. Along with exhibiting good machinability and chip breakage the material must satisfy the physical and mechanical properties required for the end use product. Those properties were obtained in the past when a lead containing alloy generally having a lead content of about 0.50 wt. % and designated by the Aluminum Association as AA 6262 alloy was utilized for making screw machine stock. There are, however, concerns that operators who are subjected to prolonged exposure to lead-containing screw machine stock, such as AA 6262, may experience harmful health effects. These concerns have created a need for a lead-free screw machine stock alloy to replace its lead-containing predecessor. The mechanical, physical and comparative characteristics of the lead-free aluminum screw machine stock alloy should perform in at least an equivalent manner to the conventional lead containing 6262 aluminum screw machine stock alloy.

The aluminum alloy of the present invention provides a suitable replacement alloy for the conventional 6262 alloy without the possible problems created by lead that is contained in the conventional alloy. Also the alloy of the present invention exhibits a degree of machinability in chip breakage characteristics that were expected for the lead containing aluminum alloy screw machine stock without sacrificing any of the physical, mechanical and comparative characteristics of the alloy. The physical properties of the alloy are dependent upon a chemical composition that is closely controlled within specific limits as set forth below and upon carefully controlled and sequenced process steps. If the composition limits or process parameters stray from the limits set forth below, the desired combination of being lead-free and important machinability properties will not be achieved.

Our invention alloy consists essentially of about 0.40 to 0.8 wt. % silicon, not more than about 0.7 wt. % iron, about 0.15 to 0.40 wt. % copper, not more than about 0.15 wt. % manganese, about 0.8 to 1.2 wt. % magnesium, about 0.04 to 0.14 wt. % chromium, not more than about 0.25 wt. % zinc, not more than about 0.15 wt. % titanium, about 0.10 to 0.7 wt. % tin, and about 0.20 to 0.8 wt. % bismuth, balance aluminum and unavoidable impurities. Our preferred alloy consists essentially of about 0.55 to 0.7 wt. % silicon, not more than about 0.45 wt. % iron, about 0.30 to 0.4 wt. % copper, not more than about 0.15 wt. % manganese, about 0.8 to 1.1 wt. % magnesium, about 0.08 to 0.14 wt. % chromium, not more than about 0.25 wt. % zinc, not more than about 0.07 wt. % titanium, about 0.15 to 0.25 wt. % tin, and about 0.50 to 0.74 wt. % bismuth, balance aluminum and unavoidable impurities.

We have found that if the alloys contains less than 0.10 wt. % tin, it does not chip well. If, however, the alloy contains more than 0.7 wt. % tin or more than 0.8 wt. % bismuth there is little, if any, beneficial effect. In addition, at higher levels of tin, the chipping and tool life is diminished.

In addition, we have found that by further narrowing the bismuth and tin ranges we can obtain additional benefits. Thus, our most preferred alloy includes bismuth ranging from about 0.50 to 0.74 wt. % and tin ranging from about 0.10 to 0.7 wt. % and even more preferably from about 0.15 to 0.25 wt. %. We have found that by further limiting the range of bismuth and tin we obtain optimum chipping and tool life for the alloy.

Initially, we cast the alloy into ingots and homogenize the ingots at a temperature ranging from about 1000° to 1170° F. for at least 1 hour but generally not more than 24 hours followed either by fan or air cooling. Preferably, we soak the ingot at about 1020° F. for about 4 hours and then cool to room temperature. Next, we cut the ingots into shorter billets, heat them to a temperature ranging from about 600° to 720° F. and then extrude the billets into a desired shape, generally a rod or bar form.

We then thermomechanically treat the extruded alloy shape to obtain the desired mechanical and physical properties. For example, to obtain the mechanical and physical properties of a T8 temper, we solution heat treat at a temperature ranging from about 930° to 1030° F., preferably at about 1000° F., for a time period ranging from about 0.5 to 2 hours, rapidly quench the heat-treated shape to room temperature, cold work the shape, and artificial age the cold worked shape at a temperature ranging from about 300° to 380° F. for about 4 to 12 hours.

To obtain a T4 temper, we cold work the shape, solution heat treat the extruded alloy shape at a temperature ranging from about 930° to 1030° F. for a time period ranging from about 0.5 to 2 hours, rapidly quench the heat-treated shape to room temperature, then straighten using any known straightening operation such as stress relieved stretching of about 1 to 3 % and naturally age the cold worked shape. To impart a T6 or T651 temper we further artificially age the T4 or T45 1 straightened shape. The artificial age cycle would be carried out in the range from about 300° to 380° F. for about 4 to 12 hours.

To obtain a T4 or T4511 temper, we solution heat treat at a temperature ranging from about 930° to 1030° F. for a time period ranging from about 0.5 to 2 hours, rapidly quench the heat-treated shape to room temperature, the shape can then be straightened by using known straightening operations such as stress relieved stretching of about 1 to 3%, and allow the shape to naturally age. To impart a T6 T6511 temper we further artificially age the T4 or T4511 shape. The artificial age cycle would be carried out in the range from about 300° to 380° F. for about 4 to 12 hours.

To obtain the properties of a T6 of T6511 temper, prior to extrusion, we heat the billets to a temperature ranging from about 950° to 1050° F. and then extrude them to a near desired size in rod or bar form. Subsequent to the extrusion process, we rapidly quench the alloy to room temperature to minimize uncontrolled precipitation of the alloying constituents. The rod or bar is then straightened using any known straightening operation such as stress relieved stretching of about 1 to 3 %. To further improve its physical and mechanical properties, we further heat treat the alloy by precipitation ar artificial age hardening. We generally accomplish this heat treatment step at a temperature ranging from about 300° to 380° F. for a time period from about 4 to 12 hours.

To obtain a T9 temper, we subject the extruded stock to a solution heat treatment at a temperature ranging from about 930° to 1030° F. for a time period ranging from about 0.5 to 2 hours, rapidly quench the heat-treated stock to room temperature, artificially age the stock at a temperature ranging from about 300° to 380° F. for a time period ranging from about 4 to 12 hours, and then we cold work the stock followed by any known straightening operation such as roll straightening.

EXAMPLE

To demonstrate the present invention, I first prepared alloys of the compositions shown in Table 1 as cast ingots, which were then homogenized at 1040° F for 4 hours, cooled to room temperature, cut to billet, reheated to 600° F, extruded into 1.188" diameter stock, solution heat treated at 1000° F for 30 minutes then rapid quenched using water and and aged at 350F for 8 hours (T8 temper).

TABLE 1

CHEMICAL COMPOSITIONS OF ALLOYS

| Alloy No. | Si | Fe | Cu | Mn | Mg | Cr | Zn | Pb (*) | Bi | Sn |
|---|---|---|---|---|---|---|---|---|---|---|
| 1 (**) | 0.608 | 0.296 | 0.268 | 0.11 | 0.98 | 0.10 | 0.016 | 0.609 | 0.62 | — |
| 2 | 0.64 | 0.356 | 0.405 | 0.126 | 1.028 | 0.12 | 0.003 | — | — | 0.20 |
| 3 | 0.64 | 0.365 | 0.333 | 0.108 | 1.01 | 0.105 | 0.005 | 0.018 | 0.316 | 0.20 |
| 4 | 0.585 | 0.338 | 0.307 | 0.10 | 0.997 | 0.101 | 0.007 | 0.017 | 0.587 | 0.20 |
| 5 | 0.591 | 0.291 | 0.282 | 0.09 | 0.968 | 0.094 | 0.007 | 0.036 | 0.002 | 0.38 |
| 6 | 0.625 | 0.277 | 0.292 | 0.103 | 0.994 | 0.107 | 0.005 | 0.037 | 0.446 | 0.38 |

(*) Trace element in primary material charged to make alloy
(**) This alloy represents typical AA6262.

The mechanical properties for each of the alloys were tested and the results are in Table 2.

TABLE 2

MECHANICAL PROPERTIES OF T8 TEMPER MATERIAL (AVERAGED)

| Alloy No. | Ultimate Tensile Strength ksi | Yield Tensile Strength ksi | Elongation % in 2-in. |
|---|---|---|---|
| 1 | 53.4 | 52.0 | 13.5 |
| 2 | 55.3 | 54.0 | 13.0 |
| 3 | 54.4 | 52.7 | 13.0 |
| 4 | 52.0 | 50.5 | 13.2 |
| 5 | 53.8 | 52.4 | 12.0 |
| 6 | 51.2 | 50.0 | 12.5 |

The data show that the six alloys have similar mechanical properties. The distribution of the data is typical for a 6262.T8 product.

Table 3 gives the results of the machine testing performed on each alloy.

TABLE 3

MACHINABILITY DATA

| Alloy No. | Tool Life - Hours to 0.005" Growth | Surface Finish Roughness Ave. | Chip Size (Note 1) |
|---|---|---|---|
| 1 | 2.5 | 23 | |
| 2 | 4.0 | 24 | |
| 3 | 6.0 | 26 | |
| 4 | 5.5 | 37 | |
| 5 | 5.0 | 21 | |
| 6 | 2.5 | 24 | |

(Note 1) Chip classification is difficult to quantify so the chips are rated by comparing one to another. The chips from Alloy No. 1 were well broken. Ths chips from Alloys No. 2 and 4 are slightly larger than Alloy No. 1 chips but are very similar. The chips from Alloys No. 3, 5 and 6 are larger in size than Alloy No. 1 and not as compact.

All six alloys were tested for anodize performance. Table 4 shows the results of that work.

TABLE 4

ANODIZE PERFORMANCE

| Alloy No. | Hardcoat | Sulfuric Acid | Bright Dip, Sulfuric Acid and Dye |
|---|---|---|---|
| 1 | Good | Good | Good |
| 2 | Good | Good | Good |

TABLE 4-continued

ANODIZE PERFORMANCE

| Alloy No. | Hardcoat | Sulfuric Acid | Bright Dip, Sulfuric Acid and Dye |
|---|---|---|---|
| 3 | Good | Good | Good |
| 4 | Good | Good | Good |
| 5 | Good | Good | Good |
| 6 | Good | Good | Good |

These data show that the alloys have equivalent anodize qualities and metallurgical structure anomalies were not seen.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

We claim:

1. A process for making an essentially lead-free screw machine stock alloy, comprising the steps of:

(a) providing a cast aluminum ingot having a composition consisting essentially of about 40 to 0.8 wt. % silicon, not more than about 0.7 wt. % iron, about 0.15 to 0.40 wt. % copper, not more than about 0.15 wt. % manganese, about 0.8 to 1.2 wt. % magnesium, about 0.04 to 0.14 wt. % chromium, not more than about 0.25 wt. % zinc, not more than about 0.15 wt. % titanium, about 0.10 to 0.7 wt. % tin, and about 0.20 to 0.8 wt. % bismuth, balance aluminum and unavoidable impurities;

(b) homogenizing the ingot at a temperature ranging from about 900° to 1060° F. for a time period of at least 1 hour;

(c) cooling;

(d) cutting the ingot into billets;

(e) heating and extruding the billets into a desired shape; and (f) thermomechanically treating the extruded alloy shape.

2. The process of claim 1, wherein the thermomechanical treatment step comprises:

(i) solution heat treating at a temperature ranging from about 930° to 1030° F. for a time period ranging from about 0.5 to 2 hours;

(ii) rapid quenching of the heat-treated shape to room temperature;

(iii) cold working the quenched shape; and (iv) artificial aging the cold worked shape to impart a T8 temper.

3. The process of claim 1, wherein the thermomechanical treatment step comprises:

(i) cold working the shape;

(ii) solution heat treating the cold worked shape at a temperature ranging from about 930° to 1030° F. for about 0.5 to 2.0 hours;

(iii) rapid quenching of the heat-treated shape to room temperature; and (iv) natural aging the quenched, heat-treated shape to impart a T4 temper.

4. The process of claim 3, further comprising stretching prior to natural aging to impart a T451 temper.

5. The process of claim 3, further comprising artificial aging to impart a T6 temper.

6. The process of claim 5, wherein the artificial aging step comprises heating from about 300° to 380° F. for about 4 to 12 hours.

7. The process of claim 4, further comprising artificial aging to impart a T651 temper.

8. The process of claim 1, wherein the thermomechanical step comprises:

(i) solution heat treating at a temperature ranging from about 930° to 1030° F. for a time period ranging from about 0.5 to 2 hours;

(ii) rapid quenching of the heat-treated shape to room temperature;

(iii) naturally aging to impart a T4 temper.

9. The process of claim 7 wherein the artificial aging step comprises heating from about 300° to 380° F. for about 4 to 12 hours.

10. The process of claim 8 further comprising straightening prior to natural aging to impart a T4511 temper.

11. The process of claim 1 wherein the thermomechanical step comprises:

(i) solution heat treating at a temperature ranging from about 930° to 1030° F. for a time period ranging from about 0.5 to 2 hours;

(ii) rapid quenching of the heat-treated shape to room temperature;

(iii) artificial aging;

(iv) cold working; and (v) straightening to impart a T9 temper.

12. The process of claim 1 further comprising artificial aging about to impart a T6511 temper.

13. The process of claim 1 further comprising artificial aging about to impart a T6 temper.

14. The process of claim 12 wherein the artificial aging step comprises heating from about 300° to 380° F. for about 4 to 12 hours to impart a T6511 temper.

15. The process of claim 13 wherein the artificial aging step comprises heating from about 300° to 380° F. for about 4 to 12 hours to impart a T6 temper.

* * * * *